US005856243A

United States Patent [19]

Geirhos et al.

[11] Patent Number: 5,856,243

[45] Date of Patent: Jan. 5, 1999

[54] TEXTILE COMPOSITE, MANUFACTURE THEREOF, USE THEREOF, AND NET COMPRISING HYBRID YARN

[75] Inventors: Josef Geirhos, Bobingen; Michael Schöps, Grossaitingen, both of Germany

[73] Assignee: Hoechst Trevira GmbH & Co KG, Germany

[21] Appl. No.: 701,243

[22] Filed: Aug. 22, 1996

[30] Foreign Application Priority Data

Aug. 23, 1995 [DE] Germany ..... 195 31 001.2

[51] Int. Cl.[6] ..... D03D 3/00

[52] U.S. Cl. ..... 442/57; 428/902; 442/189; 442/334; 442/263; 156/306.6

[58] Field of Search ..... 442/203, 209, 442/5, 35, 334, 415, 50, 51, 208, 217, 57, 263; 428/109, 902; 156/306.6

[56] References Cited

U.S. PATENT DOCUMENTS

| | | | |
|---|---|---|---|
| 4,472,086 | 9/1984 | Leach | 405/258 |
| 4,504,539 | 3/1985 | Petracek et al. | 428/195 |
| 4,576,858 | 3/1986 | Fourezon . | |
| 4,647,492 | 3/1987 | Grant et al. . | |
| 5,017,426 | 5/1991 | Greiser et al. . | |
| 5,116,668 | 5/1992 | Yamamoto et al. | 442/415 |
| 5,118,550 | 6/1992 | Bavarian et al. . | |
| 5,175,042 | 12/1992 | Chomarat . | |
| 5,399,422 | 3/1995 | Dijkema et al. . | |
| 5,508,093 | 4/1996 | Mehdorn . | |

FOREIGN PATENT DOCUMENTS

| | | |
|---|---|---|
| A 0 160 609 | 11/1985 | European Pat. Off. . |
| A 0 176 847 | 4/1986 | European Pat. Off. . |
| A0 281 643 | 9/1988 | European Pat. Off. . |
| A 0 333 602 | 9/1989 | European Pat. Off. . |
| A 0 395 548 | 10/1990 | European Pat. Off. . |
| A 0 403 403 | 12/1990 | European Pat. Off. . |
| A 0435001 | 7/1991 | European Pat. Off. . |
| A 0 530 769 | 3/1993 | European Pat. Off. . |
| A 0138294 | 4/1995 | European Pat. Off. . |
| A 0 717133 | 6/1996 | European Pat. Off. . |
| 34 175 517 | 12/1984 | Germany . |
| A 33 47 280A1 | 7/1985 | Germany . |
| 39 41 189A1 | 6/1990 | Germany . |
| A 56-5879 | 1/1981 | Japan . |
| 1 517 595 | 7/1978 | United Kingdom . |

OTHER PUBLICATIONS

Patent Abstracts of Japan, vol. 017, No. 655 (C–1136), 6 Dec. 1993 & JP–A–05 209301 (Kasuga Shokai;K), 20 Aug. 1993, & Data Base WPI Section Ch, Week 9338 Derwent Publications Ltd., London, GB; Class A 83, AN 93 297980 & JP–A–05 209 301 (Kasuga Shokai), 20 Aug. 1993.

*Primary Examiner*—James J. Bell
*Attorney, Agent, or Firm*—Connolly & Hutz

[57] ABSTRACT

Described is a composite comprising at least one textile sheet construction composed of synthetic polymer and hybrid yarn comprising reinforcing fiber and lower melting bonding fiber. Also described is a net comprising in at least one direction hybrid yarns composed of reinforcing fiber and of lower melting bonding fiber. The composites can be used for producing bituminized roofing and sealing membranes.

26 Claims, No Drawings

TEXTILE COMPOSITE, MANUFACTURE THEREOF, USE THEREOF, AND NET COMPRISING HYBRID YARN

DESCRIPTION

The invention relates to a textile composite useful in particular as loadbearing layers for producing roofing membranes or as tarpaulin or sheet.

Textile composites for producing roofing membranes have to meet a variety of requirements. For instance, they have to have sufficient mechanical strength, such as good perforation resistance and good tensile strength, in order, for example, to withstand the mechanical stresses of further processing, such as bituminization or installation. On the other hand, they have to show high resistance to thermal stress, for example in bituminization or in the form of radiant heat, and resistance to flying brands. There has therefore been no shortage of attempts to improve existing textile composites.

For instance, it is already known to combine composites based on synthetic fiber webs with reinforcing fiber, for example with glass fiber. Examples of such sealing membranes are found in GB-A-1,517,595, DE-U-77-39,489, EP-A-160,609, EP-A-176,847, EP-A403,403 and EP-A-530,769. The bonding between fiber web and reinforcing fiber is accomplished in this prior art either by adhering by means of a binder or by needling the layers of different materials together.

It is further known to produce composites by knitting or stitch-knitting techniques. Examples thereof are found in DE-A-3,347,280, U.S. Pat. No. 4,472,086, EP-A-333,602 and EP-A-395,548.

DE-A-3,417,517 discloses a textile interlining having anisotropic properties and a process for making it. The interlining consists of a substrate having a surface which melts below 150° C. and reinforcing filaments bonded thereto which melt at above 180° C. and are fixed in a parallel arrangement on that surface. In one embodiment, the substrate can be a nonwoven having on one of its surfaces fusible fibers or threads provided for producing an adhesive bond between the parallel reinforcing fibers and the nonwoven.

Similarly, DE-A-3,9417189 discloses a combination of reinforcing fiber in the form of a warp with nonwovens based on synthetic fibers which can be bonded together in various ways, including the use of adhesive fibers. The composites described, like the interlining known from DE-A-3,417,517, have anisotropic properties.

U.S. Pat. No. 4,504,539 discloses a combination of reinforcing fiber in the form of bicomponent fiber with nonwovens based on synthetic fiber.

EP-A-0,281,643 discloses a combination of reinforcing fiber in the form of a network of bicomponent fiber with nonwovens based on synthetic fiber, with the bicomponent fiber network accounting for at least 15% by weight.

JP-A-81-5879 discloses a composite provided with a network-like reinforcing material. Mixed yarn is not used.

There continues to be a need for reinforced layered products which are distinguished by enhanced strength and which are useful in particular as base materials for producing bituminized roofing or sealing membranes which exhibit improved resistance to thermal stresses during bituminization, are notable for good flame resistance, have excellent mechanical properties, for example high tensile strength, and whose tenacity is distinctly superior to those of corresponding conventional base materials.

Furthermore, in the practice of bonding nonwovens to textile sheet constructions, it has been found that needling the layers generally entails damage to the individual fibers, so that the bonded assembly does not exhibit optimum strength. Problems can also arise when nonwovens are adhered to sheet constructions, for example by calendering the unbound assembly. For instance, it has been found that the pressure exerted during calendering can damage the individual layers, so that this assembly likewise lacks optimum strength.

It is an object of the present invention to develop layered products having improved strength which are free of the above-described disadvantages and which are useful in particular as base materials for producing roofing or sealing membranes having the desired advantages. It is a further object of the present invention to find a base material whereby the bonding of the reinforcing fibers to the nonwoven can be effected without additional binder.

The present invention provides a composite comprising at least one textile sheet construction composed of synthetic polymer and hybrid yarn comprising reinforcing fiber and lower melting bonding fiber.

The term "fiber" is herein to be understood in its broadest meaning. It encompasses not only fibers of limited length (staple fibers) and the yarns produced therefrom but also continuous filament fibers in the form of a monofilament, preferably in the form of multifilament yarns.

The term "textile sheet construction" herein is likewise to be understood in its broadest sense. It can encompass all constructions in fibers from synthesized polymers or in inorganic fibers produced using a sheet-forming technique.

Examples of such textile sheet constructions are wovens, nets, knits and, preferably, webs.

Of the webs composed of synthetic polymer fibers, spunbonded webs, also known as spunbonds, which are produced by a random laydown of freshly melt-spun filaments, are preferred. They consist of continuous synthetic fibers composed of melt-spinnable polymer materials. Suitable polymer materials are for example polyamides, e.g. polyhexamethylene-adipamide, polycaprolactam, wholly or partly aromatic polyamides (aramids), wholly or partly aromatic polyesters, polyphenylene sulfide (PPS), polymers having ether and keto groups, e.g. polyether ketones (PEKs) and polyether ether ketone (PEEK), or polybenzimidazoles.

The spunbonds preferably consist of melt-spinnable polyesters. The polyester material used can in principle be any known type suitable for fibermaking. This type of polyester consists predominantly of units derived from aromatic dicarboxylic acids and from aliphatic diols. Widely used aromatic dicarboxylic acid units are the bivalent radicals of benzenedicarboxylic acids, in particular of terephthalic acid and isophthalic acid; widely used diols have 2 to 4 carbon atoms, ethylene glycol being particularly suitable. Of particular advantage are novel composites whose webs consist of a polyester material which is at least 85 mol % polyethylene terephthalate. The remaining 15 mol % are then composed of dicarboxylic acid units and glycol units, which function as modifiers and make it possible for the person skilled in the art to control the physical and chemical properties of the filaments produced. Examples of such dicarboxylic acid units are radicals of isophthalic acid and of aliphatic dicarboxylic acid such as, for example, glutaric acid, adipic acid, sebacic acid; examples of modifying diol radicals are those of longer-chain diols, for example of propanediol or butanediol, of di- or triethylene glycol or, if present in a small amount, of polyglycol having a molecular weight of about 500 to 2000.

Particular preference is given to polyesters which are least 95 mol % polyethylene terephthalate (PET), especially those composed of unmodified PET.

If the composites of the invention are additionally to have a flame retardant effect, they include with particular advantage spunbonds spun from polyesters modified to be flame retardant. Such flame retardant modified polyesters are known. They include additions of halogen compounds, especially bromine compounds, or—and this is particularly advantageous—they contain phosphorus compounds condensed into the polyester chain.

Particularly preferred flame retardant layered products of this invention comprise spunbonds of polyesters which contain condensed into the chain structural groups of the formula

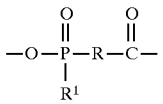

(I)

where R is alkylene or polymethylene having 2 to 6 carbon atoms or phenyl and $R^1$ is alkyl having 1 to 6 carbon atoms, aryl or aralkyl. Preferably, in the formula (I), R is ethylene and $R^1$ is methyl, ethyl, phenyl or o-, m- or p-methylphenyl, in particular methyl. Such spunbonds are described for example in DE-A-39 40 713.

The polyesters present in the webs have a molecular weight corresponding to an intrinsic viscosity (IV), measured in a solution of 1 g of polymer in 100 ml of dichloroacetic acid at 25° C., of 0.7 to 1.4.

The synthetic polymer fiber textile sheet constructions for producing the composites of this invention have typical basis weights of 20 to 400 g/m$^2$, preferably 40 to 150 g/m$^2$.

Customarily, the spunbonds are subjected in a known manner to a chemical or thermal and/or mechanical preconsolidation after their formation.

In a further embodiment of the invention, the synthetic polymer fiber textile sheet construction can also be a fusibly bonded web nonwoven comprising loadbearing and melt-bondable fibers. The loadbearing and melt-bondable fibers can be derived from any thermoplastic fiber-forming polymers. Loadbearing fibers can in addition also be derived from nonmelting fiber-forming polymers.

Examples of polymers from which the loadbearing fibers can be derived are polyacrylonitrile, polyolefins, such as polyethylene, essentially aliphatic polyamides, such as nylon-6,6, essentially aromatic polyamides (aramids), such as poly(p-phenylene terephthalate) or copolymers containing an amount of aromatic m-diamine units to improve the solubility or poly(m-phenylene isophthalate), essentially aromatic polyesters, such as poly(p-hydroxybenzoate) or preferably essentially aliphatic polyesters, such as polyethylene terephthalate.

The relative proportions of the two fiber varieties can be varied within wide limits as long as care is taken to ensure that the proportion of melt-bondable fiber is sufficient for the nonwoven to acquire sufficient strength for the desired use as a result of the bonding together of the loadbearing fibers with the melt-bondable fibers. The proportion of hot-melt adhesive in the nonwoven due to the melt-bondable fiber is customarily less than 50% by weight, based on the weight of the nonwoven.

Suitable hot-melt adhesives are in particular modified polyesters having a melting point reduced by 10° to 50° C., preferably 30° to 50° C., compared with the nonwoven raw material. Examples of such a hot-melt adhesive are polypropylene, polybutylene terephthalate or polyethylene terephthalate modified by cocondensation with longer-chain diols and/or of isophthalic acid or aliphatic dicarboxylic acids.

The hot-melt adhesives are preferably introduced into the webs in fiber form.

Preferably, loadbearing and melt-bondable fibers are composed of the same class of polymer. This is to be understood as meaning that all the fibers used are selected from one class of substances in such a way that they can be easily recycled after use of the web. If the loadbearing fibers consist for example of polyester, then the melt-bondable fibers are likewise made of polyester or of a mixture of polyesters, for example a bicomponent fiber with PET in the core and a lower melting polyethylene terephthalate copolymer as sheath.

The linear densities of the loadbearing and melt-bondable fibers can vary within wide limits. Examples of customary linear density ranges are 1 to 16 dtex, preferably 2 to 6 dtex.

If flame retardant composites of this invention are additionally bonded, they preferably include flame retardant hot-melt adhesives. The layered product of the invention can include for example a polyethylene terephthalate modified by incorporation of chain members of the above-indicated formula (I) as flame retardant hot-melt adhesive.

The filaments or staple fibers making up the nonwovens can have a virtually round cross-section or else other shapes, such as dumbbell-shaped, kidney-shaped, triangular or tri- or multilobal cross-sections. Hollow fibers can also be used. It is further possible to use the melt-bondable fibers in the form of bicomponent fibers or fibers having more than two components.

The fibers forming the textile sheet construction can also be modified by customary additions, for example by antistats, such as carbon black.

According to the invention, the above-described textile sheet constructions are reinforced with hybrid yarn. These comprise reinforcing fibers and lower melting bonding fibers. Preferably the reinforcing threads are present in the form of a textile sheet construction or as a warp thread. It is particularly advantageous to use the hybrid yarn in the form of a net consisting in at least one direction of hybrid yarns. Such nets likewise form part of the subject-matter of the present invention.

The hybrid yarn can consist of reinforcing fiber and bonding fiber from the same class of chemical substances or from different classes of chemical substances.

For instance, in one embodiment, the reinforcing fiber can be composed of individual filaments having an initial modulus of more than 50 Gpa and the bonding fiber can be composed of individual filaments composed of lower melting thermoplastic material.

Preferred reinforcing fibers in this embodiment consist of glass, carbon or aramid.

In a further embodiment, reinforcing fiber and bonding fiber consist of polymeric materials, preferably polymeric materials from the same class of polymer, especially from the same class of polymer as the fibers which make up the textile sheet construction.

In this embodiment, the individual filaments of the reinforcing fiber have an initial modulus of more than 10 Gpa. Reinforcing fibers for this embodiment consist for example of polyphenylene sulfide (PPS), polyether ether ketone (PEEK) or polyether imide (PEI).

Preferred reinforcing fibers for this embodiment are high tenacity and low shrinkage polyester fibers.

Bonding fibers in the reinforcing threads to be used according to the invention consist of thermoplastic polymer materials whose melting point is below that of the thermoplastic materials present in the textile sheet construction. Examples of such polymer materials are preferably polyolefins or modified polyesters which have a lower melting point than unmodified polyester. Examples of polyolefins are polyethylene or polypropylene. Examples of modified polyesters are the aforementioned polybutylene terephthalate types and also polyethylene terephthalate modified by cocondensation with longer-chain diols and/or isophthalic acid or aliphatic dicarboxylic acids.

The preparation of the hybrid yarn from reinforcing and bonding fibers of the above-described first embodiment is preferably effected by means of a specific hot interlacing process described in EP-B-0,455,193. In said process, to avoid filament breakages during interlacing, the filaments are first heated to close to the softening point (about 600° C. in the case of glass). The heating can be effected by godets and/or heating tube, while the low melting thermoplastic individual filaments are fed to the superordinate interlacing jet without preheating. This flat coherent hybrid yarn is easily weavable.

Suitable hybrid yarns being composed of reinforcing and bonding fibers include yarns of the type 68 tex glass/420 dtex PET.

The preparation of the hybrid yarn from reinforcing and bonding fibers of the above-described second embodiment is effected by conventional interlacing techniques, for example by intermingling or commingling techniques. As explained above, the hybrid yarns are preferably used in the form of a net which is likewise part of the subject-matter of the present invention.

The thread density of the net of this invention can vary within wide limits depending on the desired property profile. On the one hand, the thread densities can be the same in all directions; on the other, the nets can for example have a thread density between 0.5 and 10 threads per cm in the direction of the hybrid yarns and a thread density between 0.5 and 1 thread/cm in the other direction. The thread density is measured perpendicularly to the respective thread direction, and the thread density can be the same for all sets of threads present, or different thread densities can be used depending on the expected demands.

The hybrid yarn can have a wide range of elongation at break, for example from about 2.5 to 25%, depending on the desired property profile.

The tenacity of the hybrid yarn can vary within wide limits depending on the desired property profile, for example within the range from 20 to 150 cN/tex.

The linear density of the hybrid yarn in the composite is advantageously 30 to 3000 dtex.

Nets for the purposes of the present invention are grids formed by mutually angled sets of parallel threads fixed to one another at their crossing points, at least one set of threads comprising hybrid yarns.

The fixing of the threads at their crossing points is preferably effected by incipient or complete melting of the bonding fibers, especially without the use of further adhesives. In a preferred embodiment, the fixing of the threads at their crossing points is effected by partially melting the bonding fibers, so that the predominant portion of the bonding fibers retains its fibrous form. This embodiment makes possible a very uniform distribution of the hot-melt adhesive during the later formation of the composite.

The angle between the crossing sets of threads is generally between 10° and 90°. A net can of course include more than just two sets of threads. The number and direction of the sets of threads depends on possible special requirements.

Preference is given to nets consisting of two sets of threads crossing at an angle of preferably 90°. If a particularly high mechanical strength is required in one direction, for example the longitudinal direction, of the layered product, it is advisable to incorporate a net formed in the longitudinal direction of a set of threads having a lower interthread spacing and stabilized for example by a transverse set of threads or by two sets of threads forming angles of respectively about +40° to +70° and −40° to −70° with the first set.

Particular strength requirements in all directions can be met with a net of 4 or 5 sets of threads which are superposed in various directions and bonded to one another at the thread crossing points. An Example of such a special net is shown in EP-A-572,891.

The composites of this invention are customarily manufactured by separate manufacture of the individual layers, subsequent combination of these layers and subsequent adhering together of the layer by heating, optionally under employment of pressure, so that the low melting thermoplastic filaments of the bonding fiber melt incipiently or completely and enter a bond with the adjoining surface of the textile sheet construction composed of synthetic polymer fiber.

The composites of this invention do not show any tendency to delaminate, nor do they warp or crack, even under high thermomechanical stress.

The composites of this invention show remarkably little widthways contraction when being bituminized compared with conventional membranes.

It is also found that the composite of this invention provides planar, sheet-stable, blister-free bituminous membranes even under rough bituminizing conditions. Moreover, the penetration resistance increase , as is manifested in the punch pressure test of DIN 54307. The result is an appreciably improved processibility and enhanced consistency when installing the bituminized roofing membrane of this invention on the roof.

Advantageously a composite comprising web/net/web is used.

The composites of this invention can be used for manufacturing bituminized roofing and sealing membranes. This is likewise part of the subject-matter of the present invention. To this end, the base material is conventionally treated with bitumen and then optionally besprinkled with a granular material, for example with sand. The roofing and sealing membranes produced in this way are notable for good processibility.

The production of the composite of this invention comprises the measures of:

a) producing a textile sheet construction in a conventional manner;

b) providing hybrid yarn on a surface of the textile sheet construction obtained in a), c) optionally providing a further textile sheet construction on the other side of the hybrid yarn and d) exerting elevated temperature and/or pressure so that the lower melting bonding filament of the hybrid yarn melts incipiently or completely to form an adhesive layer between the sheet constructions and the composite receives its final consolidation.

In what follows, the production of the composite of this invention is illustrated with reference to a spunbond as textile sheet construction.

The spunbond is formed by means of spinning apparatus known per se. To this end, the molten polymer is spun through a plurality of successive rows of spinning jets or groups of spinning jet rows alternately supplied with polymers which form the loadbearing fiber and the meltbendable fiber. The extruded polymer streams are conventionally attenuated and, for example by means of a rotating impingement plate, laid down on a conveyor belt in sprinkle texture.

The primary web produced in this way is then conventionally thermally preconsolidated by treating it for example in a preconsolidator with a hot roll, so that at least part of any melt-bondable fiber present melts, whereby the primary web is consolidated to such an extent that it can be handled without the conveyor belt. This form of preconsolidation is described for example in DE-C-3,322,936. Thereafter the net of yarns consisting in at least one yarn direction of hybrid yarn is applied to the resulting surface of the primary web. Thereafter, by the action of elevated temperature and/or pressure, the lower melting bonding filament of the hybrid yarn is incipiently or completely melted so that an adhesive layer forms between the two sheet constructions and the composite receives its final consolidation. The providing of the hybrid yarn in the form of a net can take place on one or both sides. Instead of two nets it is also possible to provide a web for a web/net combination. Thereafter the ready-produced layered product is wound up in a conventional manner.

The process described above can be varied in many ways without departing from the basic concept of the present invention. For instance, various sequences of loadbearing and melt-bondable polymers can be provided to produce variously layered spunbonds. Also, instead of the sheet construction, it is possible to provide a layered product composed of nonwoven and unilaterally applied sheet construction, so that a sandwich structure results. Furthermore, a plurality of alternating layers [web-(net-web)$_x$] can be combined to form a sandwich construction. It is readily possible to use more than two types of polymer in the production of the nonwoven or to use the melt-bondable fibers in the form of bicomponent fibers or fibers having more than two components. In addition, the process described can also be carried out in discrete steps by, for example, interrupting it following the final consolidation of the spunbond and effecting the combination with the sheet construction and an adhering of the layers in a separate operation.

The examples which follow illustrate the invention without limiting it.

EXAMPLES 1–7

Composites of spunbond with nets comprising various mixed yarns were produced and tested.

Spunbonds based on polyethylene terephthalate filaments were produced in a spunbonder. Type A had a basis weight of 60 g/m$^2$, a tensile strength of 13.0 daN/tex per 5 cm width and an elongation at break of 24.5%; type B had a basis weight of 60 g/m$^2$, a tensile strength of 15.7 daN/5 cm width and an elongation at break of 15.7%. The primary web was provided with various nets, the construction of which is shown below in the table. The layered product obtained was processed by calendering to form a composite according to the invention. Production conditions and properties of the products obtained are shown below in the table.

TABLE

| | | | | Calendering roll | | Mechanical properties of the composite | |
|---|---|---|---|---|---|---|---|
| Ex. No. | Spun-bond | Net composed of mixed yarns of the type | Number of threads per cm of parallel sets of threads | Tempera-ture(°C.) | Pressure (N/cm$^2$) | Tensile strength (daN/5 cm) | Elongation at break (%) |
| 1 | A | Carbon fiber + isophthalic acid modified PET fiber | 3 | 205 | 20 | 294 | 2.4 |
| 2 | A | Glass fiber + isophthalic acid modified PET fiber | 6 | 200 | 10 | 100.5 | 3.5 |
| 3 | A | Aramid fiber + isophthalic acid modified PET fiber | 6 | 230 | 10 | 157.7 | 4.4 |
| 4 | A | Polyethylene terephthalate fiber + isophthalic acid modified PET fiber | 6 | 205 | 10 | 131.2 | 20.1 |
| 5 | B | PEI fiber + isophthalic acid modified PET fiber | 6 | 190 | 10 | 65.3 | 5.2 |
| 6 | B | PEEK fiber +isophthalic acid modified PET fiber | 6 | 205 | 10 | 105.7 | 19.1 |
| 7 | B | PPS fiber + isophthalic acid modified PET fiber | 6 | 205 | 10 | 96.5 | 21.5 |

What is claimed is:

1. A composite comprising at least one textile sheet construction composed of fibers from synthesized polymers or inorganic fibers, the textile sheet construction being reinforced by a hybrid yarn comprising reinforcing fiber and lower melting bonding fiber from a thermoplastic polymer material.

2. The composite of claim 1, wherein the textile sheet construction is a web.

3. The composite of claim 1, wherein the textile sheet construction comprises polyester fiber.

4. The composite of claim 1, wherein the textile sheet construction has flame retardant properties.

5. The composite of claim 1, wherein the textile sheet construction has a basis weight of 20 to 400 g/m$^2$.

6. The composite of claim 1, wherein the textile sheet construction is a fusibly bonded web nonwoven.

7. The composite of claim 1, wherein the hybrid yarn is composed of filaments.

8. The composite of claim 1, wherein the individual filaments of the reinforcing fiber have an initial modulus of more than 50 GPa.

9. The composite of claim 8, wherein the reinforcing fiber is selected from the group consisting of glass, carbon and aramid fiber.

10. The composite of claim 1, wherein the reinforcing fiber consists of polyester.

11. The composite of claim 1, wherein the hybrid yarn consists of polymeric materials of the same chemical class of substances.

12. The composite of claim 1, wherein the hybrid yarn is present in the form of a weave construction.

13. The composite of claim 1, wherein the hybrid yarn is present in the form of a warp thread construction.

14. The composite of claim 1, wherein the hybrid yarn is present in the form of a net.

15. The composite of claim 14, wherein the net has a thread density between 0.5 and 10 threads per cm.

16. The composite of claim 13, wherein the warp thread has a thread density between 0.5 and 10 threads per cm.

17. A net comprising in at least one direction hybrid yarn.

18. The net of claim 17, wherein the bonding fiber of the hybrid yarn has partially melted and consolidates the net at the crossing points of the sets of threads forming the net.

19. The net of claim 17, wherein the hybrid yarn is composed of filaments.

20. The net of claim 17, wherein the individual filaments of the reinforcing fiber have an initial modulus of more than 50 GPa.

21. The net of claim 19, wherein the reinforcing fiber is selected from the group consisting of glass, carbon and aramid fiber.

22. The net of claim 17, wherein the reinforcing fiber and the bonding fiber consist of polymeric materials.

23. The net of claim 22, wherein the reinforcing fiber consists of polyester.

24. The net of claim 22, wherein the reinforcing fiber and the bonding fiber of the hybrid yarn consist of polymeric materials of the same chemical class of substances.

25. The net of claim 17, wherein the thread density is between 0.5 and 10 threads per cm.

26. A process for producing the composite of claim 1, comprising the measures of:

a) producing a textile sheet construction in a conventional manner;

b) providing hybrid yarn on a surface of the textile sheet construction obtained in a), c) optionally providing a further textile sheet construction on the other side of the hybrid yarn and d) exerting elevated temperature and/or pressure so that the lower melting bonding filament of the hybrid yarn melts incipiently or completely to form an adhesive layer between the sheet constructions and the composite receives its final consolidation.

* * * * *